US006966353B2

(12) United States Patent
Hsu

(10) Patent No.: US 6,966,353 B2
(45) Date of Patent: Nov. 22, 2005

(54) RETAINING BRACKET STRUCTURE FOR CORDLESS CONTINUOUS FOLDING BLIND

(75) Inventor: Ben Hsu, Changhua Hsien (TW)

(73) Assignee: Ching Feng Blinds, Ind. Co., Ltd., Changhua Hsien (TW)

( * ) Notice: Subject to any disclaimer, the term of this patent is extended or adjusted under 35 U.S.C. 154(b) by 78 days.

(21) Appl. No.: 10/660,513

(22) Filed: Sep. 12, 2003

(65) Prior Publication Data

US 2005/0056379 A1 Mar. 17, 2005

(51) Int. Cl.[7] ..... A47H 5/00

(52) U.S. Cl. ..... 160/84.04; 160/168.1 R; 160/349.2

(58) Field of Search ..... 160/84.04, 84.01, 160/168.1 R, 173 R, 178.1 V, 349.2; 248/229.16

(56) References Cited

U.S. PATENT DOCUMENTS

| | | | | | |
|---|---|---|---|---|---|
| 357,893 | A | * | 2/1887 | Banta | 248/442.2 |
| 2,216,886 | A | * | 10/1940 | Langelier | 248/311.2 |
| 2,661,058 | A | * | 12/1953 | Walker | 160/178.3 |
| 2,662,593 | A | * | 12/1953 | Walker | 160/178.3 |
| 3,154,276 | A | * | 10/1964 | Havener | 248/73 |
| 3,295,812 | A | * | 1/1967 | Schneider et al. | 248/229.16 |
| 3,521,332 | A | * | 7/1970 | Kramer | 403/188 |
| 4,541,598 | A | * | 9/1985 | Villanueva et al. | 248/222.12 |
| 4,914,791 | A | * | 4/1990 | Lorber | 24/67.9 |
| 5,158,127 | A | * | 10/1992 | Schumacher | 160/84.07 |
| 5,947,177 | A | * | 9/1999 | Kratzer | 160/178.1 V |
| 6,062,292 | A | * | 5/2000 | Bryant | 160/178.1 R |
| 6,601,809 | B1 | * | 8/2003 | Gebrara | 248/229.16 |

* cited by examiner

*Primary Examiner*—Bruce A. Lev
(74) *Attorney, Agent, or Firm*—Troxell Law Office, PLLC

(57) ABSTRACT

A retaining bracket structure for a cordless continuous folding blind including a pair of flexible retaining brackets. Each of the two flexible retaining brackets, of plastic materials, is made up of a pressing plate protruding at the middle section thereof, a pair of C-shaped clamping arms symmetrically extending at both sides of the pressing plate thereof, and a pointed hook bending inwards at each end of the C-shaped clamping arms thereof. In operation, the pressing plate of the flexible retaining bracket is applied from a front of the blind to abut against an upper side of the continuous folding blind collected from bottom to top at a desirable position, and the C-shaped clamping arm are bent downwards to extend backwards at the underside until the pointed hooks clamp from a rear of a top of the collected continuous folding blind. Thus, the collected continuous folding blind is clipped tight by the pressing plate and the C-shaped clamping arms and confined by the C-shaped clamping arms and the pointed hooks.

2 Claims, 4 Drawing Sheets

RETAINING BRACKET STRUCTURE FOR CORDLESS CONTINUOUS FOLDING BLIND

BACKGROUND OF THE INVENTION

The present invention is related to a retaining bracket structure for a cordless continuous folding blind, including a continuous folding blind attached to the underside of an upper beam, and a pair of flexible retaining brackets wherein the flexible retaining bracket, of plastic materials, is made up of a pressing plate protruding at the middle section thereof, a pair of C-shaped clamping arms symmetrically extending at both sides of the pressing plate thereof, and a pointed hook bending inwards at each end of the C-shaped clamping arms thereof; whereby, the continuous folding blind collected from bottom to top is clipped tight at the pressing plate and the C-shaped clamping arms there-between, and confined at the C-shaped clamping arms and the pointed hooks therein for secure location. Thus, even under the swing of strong wind, the retaining brackets thereof can securely collect and locate the continuous folding blind at a desirable position without easily getting loose or detached there-from in use.

Please refer to FIG. 1. A conventional retaining structure for a continuous folding blind is made up of an upper beam 10, a continuous folding blind 11 attached to the bottom of the upper beam 10 thereof, and a flexible clip 12 having a cavity 121 defined thereon. When the continuous folding blind 11 is collected to the desired position, the flexible clip 12 is applied and pushed from one side of the continuous folding blind 10 to clamp the gathered slats of the folding blind 10 at the cavity 121 therein for location thereof.

There are some drawbacks to such conventional retaining structure of a continuous folding blind. Most of all, the flexible clip 12 is separately applied onto the continuous folding blind 11 from outside. Once under the swing of strong wind, the flexible clip 12 is easily detached from the continuous folding blind 11, disarraying the collected continuous folding blind 11.

SUMMARY OF THE PRESENT INVENTION

It is, therefore, the primary purpose of the present invention to provide a retaining bracket structure for a cordless continuous folding blind, including a continuous folding blind attached to the underside of an upper beam, and a pair of flexible retaining brackets wherein the flexible retaining bracket, of plastic materials, is made up of a pressing plate, a pair of C-shaped clamping arms symmetrically extending at both sides of the pressing plate thereof, and a pointed hook bending inwards at each end of the C-shaped clamping arms thereof; whereby, the continuous folding blind collected from bottom to top is clipped tight at the pressing plate and the C-shaped clamping arms there-between, and confined at the C-shaped clamping arms and the pointed hooks therein. Thus, even under the swing of strong wind, the retaining brackets thereof can securely collect and locate the continuous folding blind at a desirable position without easily getting loose or detached there-from in use.

DETAILED DESCRIPTION OF THE PREFERRED EMBODIMENTS

Figure 1:
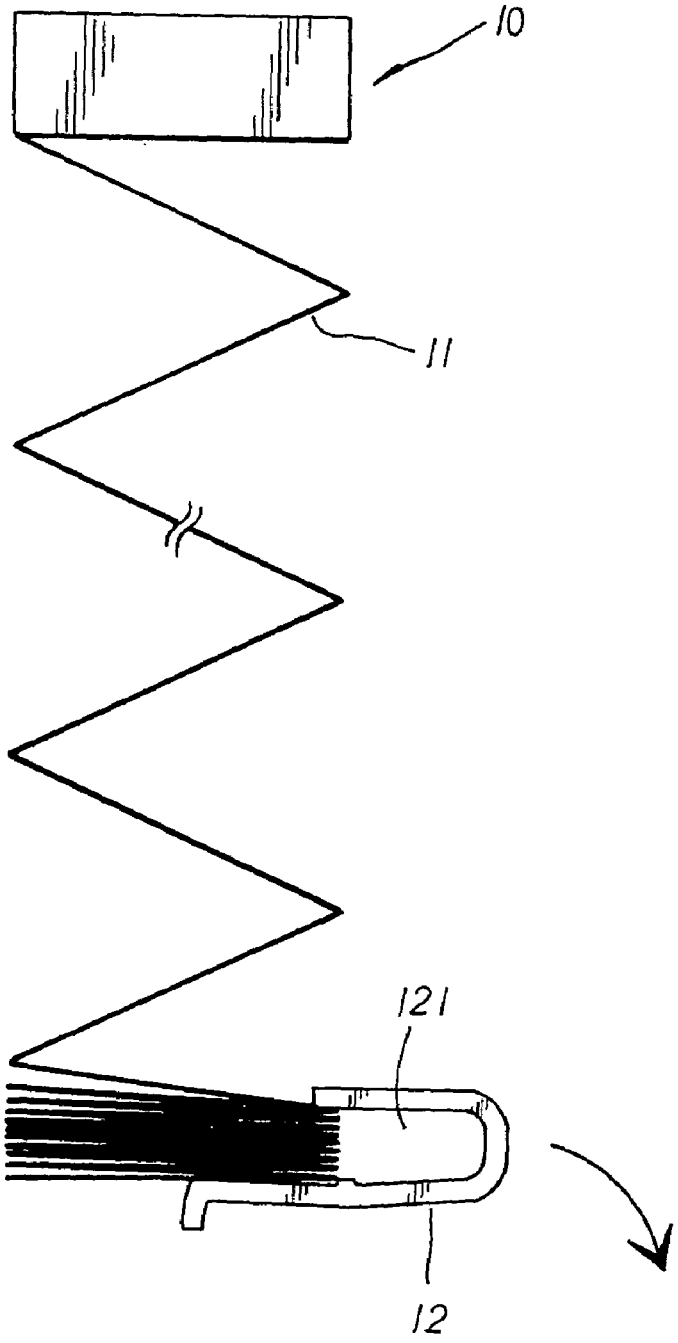
FIG. 1 PRIOR ART
FIG. 1 is a sectional view of a conventional retaining structure of a cordless continuous folding blind in use.
Figure 2:
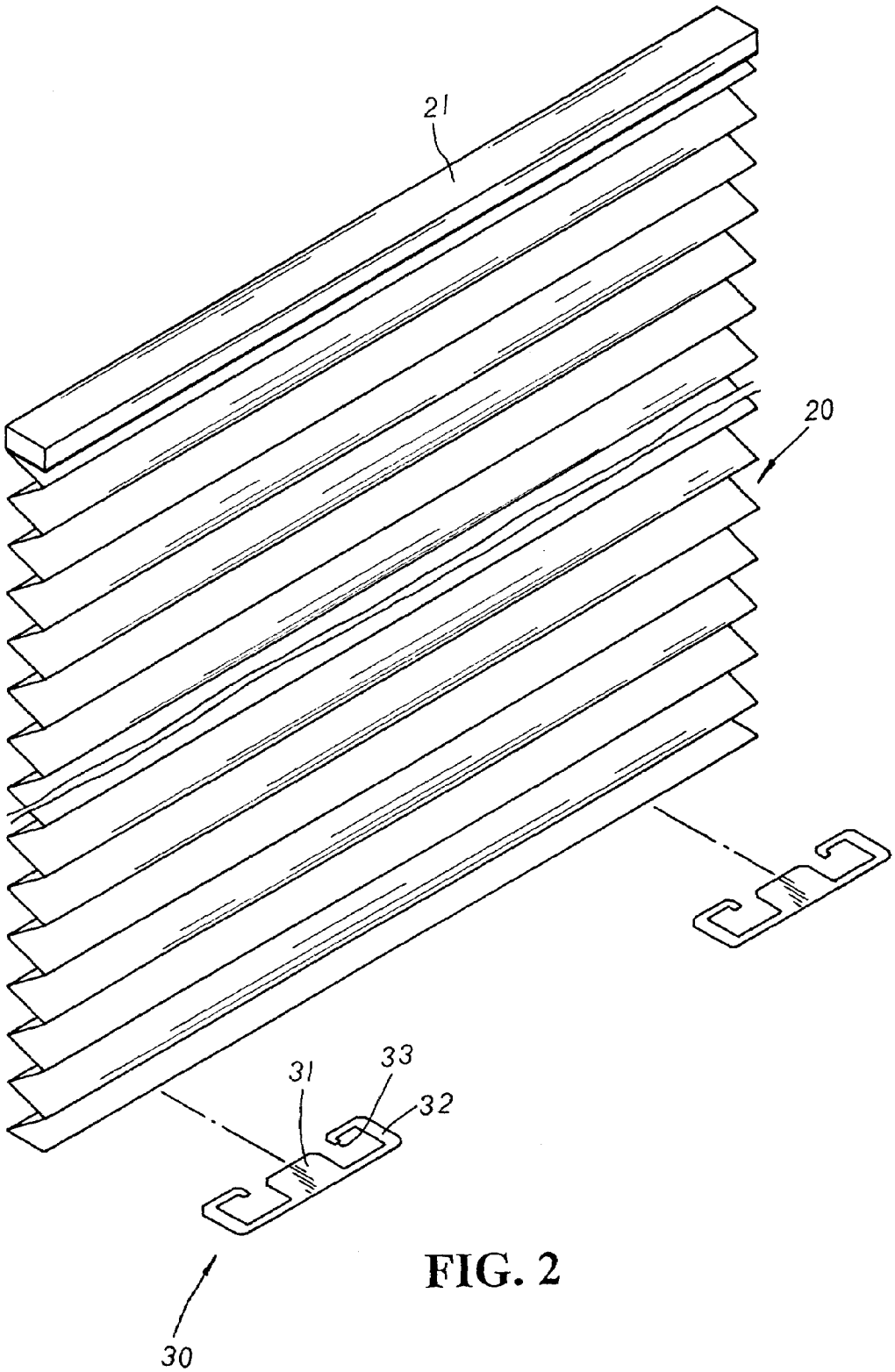
FIG. 2 is a perspective exploded view of the present invention.

Please refer to FIG. 2. The present invention is related to a retaining bracket structure for a cordless continuous folding blind, including a continuous folding blind 20, and a pair of flexible retaining brackets 30 wherein the continuous folding blind 20 is attached to the underside of an upper beam 21. The flexible retaining bracket 30, of plastic materials, is made up of a pressing plate 31 protruding at the middle section thereof, a pair of C-shaped clamping arms 32 symmetrically extending at both sides of the pressing plate 31 thereof, and a pointed hook 33 bending inwards at each end of the C-shaped clamping arms 32 thereof.

Figure 3:
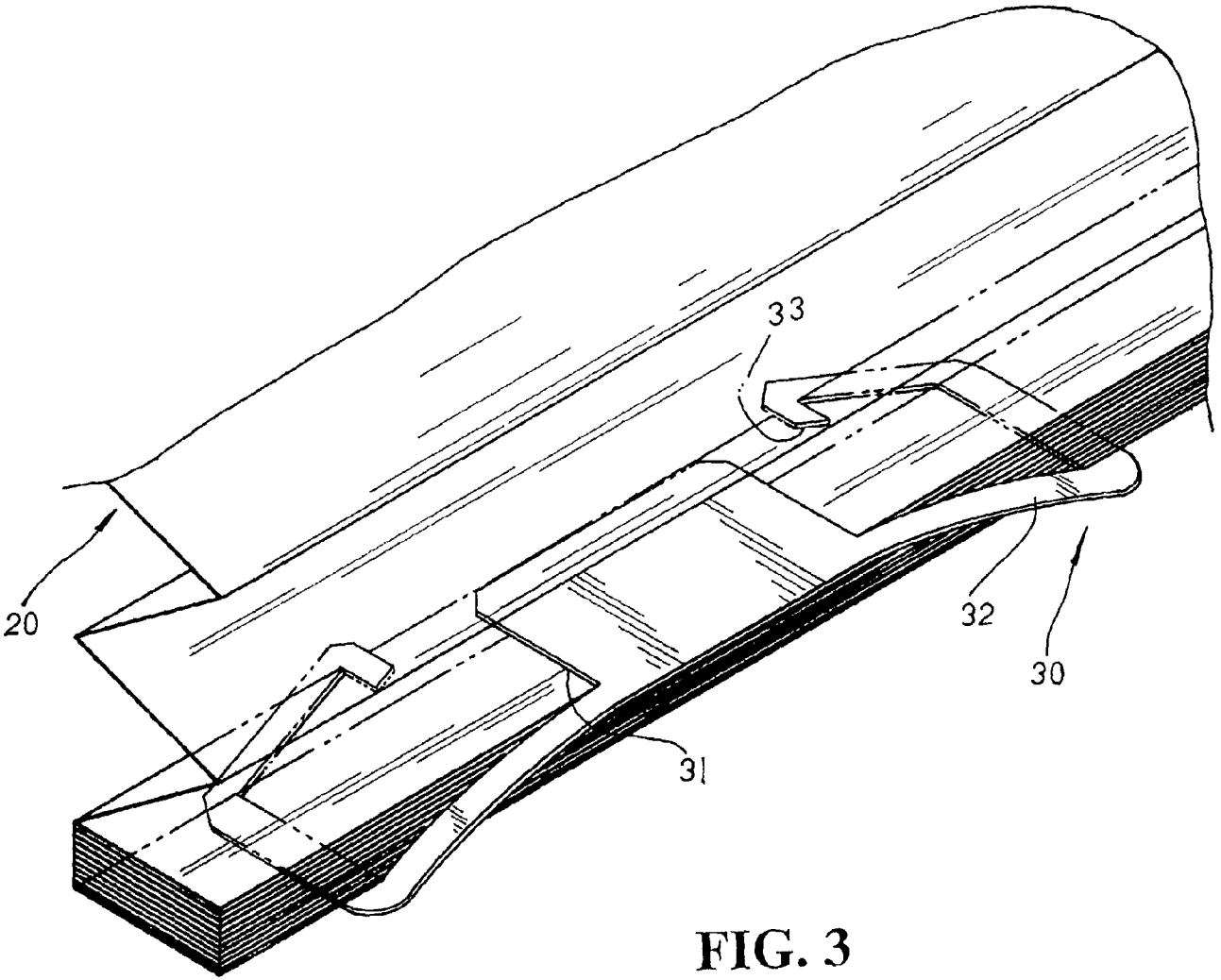
FIG. 3 is an enlarged perspective view of the present invention in operation.
Figure 4:
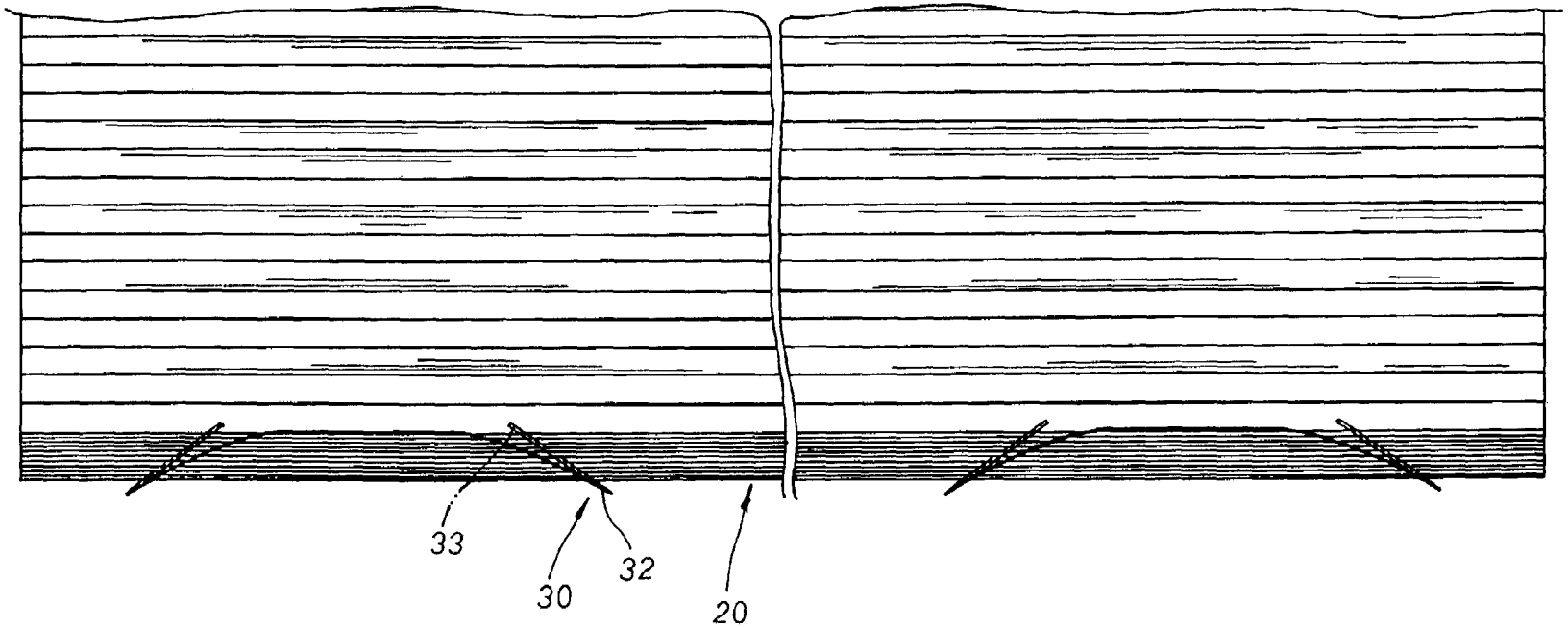
FIG. 4 is a sectional view of the present invention in collection.

Please refer to FIG. 3. To collect the continuous folding blind 20, the slats of the continuous folding blind 20 thereof are gathered from bottom to top till a desirable position is reached. The pressing plate 31 of the flexible retaining bracket 30 is applied from the front side of the continuous folding blind 20 to abut against the upper side of the collected continuous folding blind 20. The C-shaped clamping arms 32 disposed at both sides thereof are bent downwards respectively to extend backwards at the underside of the collected continuous folding blind 20 thereof with the pointed hooks 33 thereof clamping in reverse at the top of the collected continuous folding blind 20 from the rear side thereof. The collected continuous folding blind 20 is then clipped tight by the pressing plate 31 and the C-shaped clamping arms 32 thereof and confined at the C-shaped clamping arms 32 and the pointed hooks 33 therein for secure location as shown in FIG. 4. Thus, even under the swing of strong wind, the retaining brackets 30 thereof can securely collect and locate the continuous folding blind 20 at a desirable position without easily getting loose or detached there-from in practical use.

What is claimed is:

1. A retaining bracket structure for a cordless continuous folding blind comprising:

a pair of flexible brackets, each of the pair of flexible brackets having:

a) a pressing plate located in a center thereof;

b) two clamping arms having a C-shape, one of the two clamping arms is connected at a first end thereof to each of two opposing sides of the pressing plate; and c) two pointed hooks, one of the two pointed hooks is located on a second end of each of the two clamping arms and protruding inwardly toward the first end of each of the two clamping arms, wherein each of the pair of flexible brackets is removably connected to a folded blind section being a predetermined length of the cordless continuous folding blind, the pressing plate and the two pointed hooks are located on a top of the folded blind section and the two clamping arms extend around a bottom of the folded blind section.

2. The retaining bracket structure according to claim 1, wherein the pair of flexible brackets are made of a plastic material.

* * * * *